US007138069B2

(12) United States Patent
Sato et al.

(10) Patent No.: US 7,138,069 B2
(45) Date of Patent: Nov. 21, 2006

(54) METHOD OF SURFACE-FINISHING STAINLESS STEEL AFTER DESCALING

(75) Inventors: Eiji Sato, Tokyo (JP); Youichi Nakamura, Tokyo (JP)

(73) Assignee: Parker Corporation, Tokyo (JP)

( * ) Notice: Subject to any disclaimer, the term of this patent is extended or adjusted under 35 U.S.C. 154(b) by 41 days.

(21) Appl. No.: 10/499,964

(22) PCT Filed: Oct. 21, 2002

(86) PCT No.: PCT/JP02/10874

§ 371 (c)(1),
(2), (4) Date: Oct. 22, 2004

(87) PCT Pub. No.: WO03/056063

PCT Pub. Date: Jul. 10, 2003

(65) Prior Publication Data

US 2005/0040138 A1 Feb. 24, 2005

(30) Foreign Application Priority Data

Dec. 25, 2001 (JP) ..... 2001-391656

(51) Int. Cl.
*C23F 1/00* (2006.01)

(52) U.S. Cl. ..... 216/100; 216/32; 216/83; 216/96; 134/2; 134/3; 134/26; 148/592

(58) Field of Classification Search ..... 216/32, 216/83, 100, 96, 108, 109; 134/2, 3, 26; 148/592

See application file for complete search history.

(56) References Cited

U.S. PATENT DOCUMENTS

| | | | | | |
|---|---|---|---|---|---|
| 3,673,094 | A * | 6/1972 | Kreml | 252/79.4 |
| 3,694,334 | A * | 9/1972 | Bombara | 205/716 |
| 3,959,028 | A * | 5/1976 | Jackson | 419/19 |
| 5,496,449 | A * | 3/1996 | Ishibashi et al. | 205/762 |
| 5,830,291 | A * | 11/1998 | McGuire et al. | 148/610 |
| 6,150,040 | A | 11/2000 | Suzuki et al. | 428/667 |
| 6,291,761 | B1 * | 9/2001 | Takada et al. | 136/244 |

FOREIGN PATENT DOCUMENTS

| | | |
|---|---|---|
| JP | 11029877 | 2/1999 |
| JP | 11172459 | 6/1999 |
| JP | 2001081573 | 3/2001 |

* cited by examiner

*Primary Examiner*—Shamim Ahmed
(74) *Attorney, Agent, or Firm*—Stevens, Davis, Miller & Mosher, LLP

(57) ABSTRACT

A new surface finishing process for stainless steel where beautiful, bright and milky white coloured surface is obtainable even for such grades as high carbon containing 13 chromium steel and high sulfur containing free cutting stainless steel is disclosed. After removing the surface scale, (1) immerse the stainless steel into the 1st treating solution containing nitric acid: 5–40 g/l, hydrofluoric acid: 2–10 g/l and Fe(III) ion: 15–40 g/l for 5–180 sec., then rinse in water, (2) and successesively immerse into the 2nd treating solution containing nitric acid: 120–250 g/l, Fe(III) ion: 15–40 g/l for 30–300 sec., then rinse in water.

3 Claims, 2 Drawing Sheets

METHOD OF SURFACE-FINISHING STAINLESS STEEL AFTER DESCALING

FIELD OF THE INVENTION

This invention relates to a surface finishing process for martensitic stainless steel being carried out after removal of its surface scale formed in hot working and/or heat treatment process.

BACKGROUND ART

A surface scale being formed on the stainless steel in hot working and/or heat treatment process is removed in a descaling line by immersing, for example, into a sulfuric acid or a hydrochloric acid solution, or in a supplemental acid solution after being treated in a salt bath. And then, a surface finishing process has been further carried out in order to give a corrosion resistance or brightness to the surface.

And the process of immersing into the nitric-hydrofluoric acid solution or into the nitric acid solution has been carried out conventionally for the surface finishing process. However, for such grade of stainless steel as, for example, high carbon containing martensite stainless steel or sulfur containing free cutting martensitic stainless steel, those conventional processes have been showing problems of giving a yellowish, greyish or spotted colour to the surface and to give an inferior brightness to the surface of the stainless steel.

The purpose of this invention is to provide a novel surface finishing process where yellowish, greyish or spotted colour will not arise on the surface of the stainless steel. Namely, the purpose of this invention is to provide a new surface finishing process being carried out after the descaling process, wherein a beautiful, bright and milky white coloured surface can be obtained even for such stainless steel as high carbon containing about 17 chromium steel (JIS SUS440C etc) and high sulphur containing 13 chromium steel (JIS SUS416, SUS420F etc), instead of the conventional surface finishing process where rough, yellowish and greyish coloured surface has been resulted.

DISCLOSURE OF THE INVENTION

This invention is a surface finishing process for stainless steel being carried out after removal of the surface scale formed in hot working and/or heat treatment process, wherein (1) immerse the stainless into a 1st treating solution containing nitric acid: 5–40 g/l, hydrofluoric acid: 2–10 g/l and Fe(III) ion: 15–40 g/l for 5–180 sec., then water rinsed, (2) and successively immerse into a 2nd treating solution containing nitric acid: 120–250 g/l and Fe(III) ion: 15–40 g/l for 30–300 sec.

The nitric acid concentration in the 1st treating solution of this invention is 5–40 g/l. In order to slightly dissolve and make smooth the descaled rough surface of the stainless steel, pH value is preferable to be kept less than 1.00. And when the concentration of the nitric acid in the 1st treating solution is less than 5 g/l, it becomes not easy to keep the pH value to be less than 1.00. However, when it is over 40 g/l, the dissolving of the surface is excessively accerelated.

The concentration of hydrofluoric acid in the 1st treating solution of this invention is 2–10 g/l. When it is less than 2 g/l, the dissolving of the surface may not be promoted for a material of high corrosion resistance. However, when it is over 10 g/l, the dissolving of the surface is excessively promoted for a material of low corrosion resistance such as JIS SUS430 or 440C.

The concentration of Fe(III) ion in the 1st treating solution of this invention is 15–40 g/l. Fe(III) ion may react with undissociated hydrofluoric acid and effectively may keep the amount of the undissociated hydrofluoric acid in the solution. When it is less than 15 g/l, the reactive power of above may be too weak. However, when it is over 40 g/l, crystallized iron fluoride compounds may appear and cause problems.

After immersing into the 1st treating solution, water rinsing shall be carried out thoroughly in this invention. In the treatment of immersing into the 1st treating solution, small sized smut may appear on the surface of the stainless steel, and these smut have to be removed thoroughly in this water rinsing. By this water rinsing, effects brought by the 2nd treating solution may be enhanced, and the more beautiful surface of the stainless steel becomes obtainable. Hot water rinsing may be used in this water rinsing.

The concentration of nitric acid in the 2nd treating solution of this invention is 120–250 g/l. When it is less than 120 g/l, chemical reaction with evolving hydrogen may appear and the dissolving of the surface of the stainless steel may be activated and accerelated for low chromium containing stainless steel. In case of increased concentration of the nitric acid, an oxydizing reaction brought by the nitric acid may become more enhanced and the surface of the stainless steel tends to become passivated. However, when it is over 250 g/l, it may change to become more activated and may strongly dissolve the stainless steel with vigorous evolution of $NO_x$ gas, which leads the surface of the stainless steel to be rough and blackish grey colour.

The concentration of Fe(III) ion in the 2nd treating solution of this invention is 15–40 g/l. As precisely explained later, the brightness of the surface of the stainless steel is enhanced in this invention by repeating alternate proceedings of slightly dissolve the surface and passivate it, and Fe(III) ion may keep continue these repeating of alternate reactions. When the concentration of Fe(III) ion is less than 15 g/l, the effect to keep continue the reaction becomes insufficient. It may be allowed to be over 40 g/l, however, it is economically unsuitable. The concentration of around 25 g/l may be preferable in operation. Water rinsing shall be carried out after the step of immersing into the 2nd treating solution. Hot water rinsing is applicable instead of water rinsing.

According to this invention where both treatments of using the 1st treating solution and the 2nd treating solution of this invention are carried out, stainless steel having the surface of bright and milky white colour may be obtained. And these stainless steel are preferable since their bright and milky white coloured surface are fine and smooth, and further they are sufficiently passivated.

In this invention, the duration of immersing in the 1st treating solution is 5–180 sec, and the duration of immersing in the 2nd treating solution is 30–300 sec. Strictly speaking, the most preferable duration in the 1st treating solution as well as that in the 2nd treating solution may vary depending on a grade of stainless steel to be treated. However, the most preferable duration may easily be decided by carrying out in advance a immersing test within the scoupe of the above explained duration. Namely, the most preferable duration may easily be determined by referring the result of the immersing test where bright and milky white coloured surface is obtained.

MODE FOR CARRYING OUT THE INVENTION

The inventors provided hot rolled and heat treated wire rod of free cutting 13% chromium steel (JIS SUS420F) containing 0.35% sulfur and of 7 mm diameter as specimen. Specimens were subjected to the finishing processes shown in Table 1 after being descaled by sulfuric acid pickling→salt bath immersion→nitric-hydrofluoric acid pickling.

No. 1–7 in Table 1 are embodiment examples of this invention where the 1st treating solution and the 2nd treating solution of this invention were used. Wherein water rinsing were thoroughly carried out in between the treatment by 1st treating solution and the 2nd treating solution, and also after the treatment by the 2nd treating solution. No. 8–14 in Table 1 are comparative examples where the 1st treating solution was a conventional high concentrated nitric-hydrofluoric acid solution and the 2nd treating solution was a conventional nitric acid solution without any addition of Fe(III) ion. Water rinsing were carried out thoroughly also in comparative examples between the 1st treating solution and the 2, and after the 2nd treating solution.

As shown in the column of surface condition on 1st treating solution in Table 1, the 1st treating solution of No. 1–7 of this invention did not excessively attack the surface of the stainless steel. Namely, the surface of the stainless steel after being treated by the 1st treating solution of the invention was showing a mixed colour of greyish and white or a mixed colour of blackish and white as shown in mark Δ, and any sign of being severely attacked was not observed. Whereas, the 1st treating solution of No. 8–14 of comparative example excessively attacked the surface of the stainless steel and was showing blackish coloured surface as shown in mark x in Table 1.

As shown in the column of surface condition on 2nd treating solution in Table 1, all of the 2nd treating solution of No. 1–7 of this invention brought a bright and milky white coloured surface. These are showing that the smoothing of the surface of the stainless steel was resulted by repeating the alternate proceedings of slightly dissolving the surface of the stainless steel and then passivating it. Whereas, surface condition of comparative example of No. 8–14 was blackish coloured and showing that their smoothing effects had been insufficient.

Figure 1:
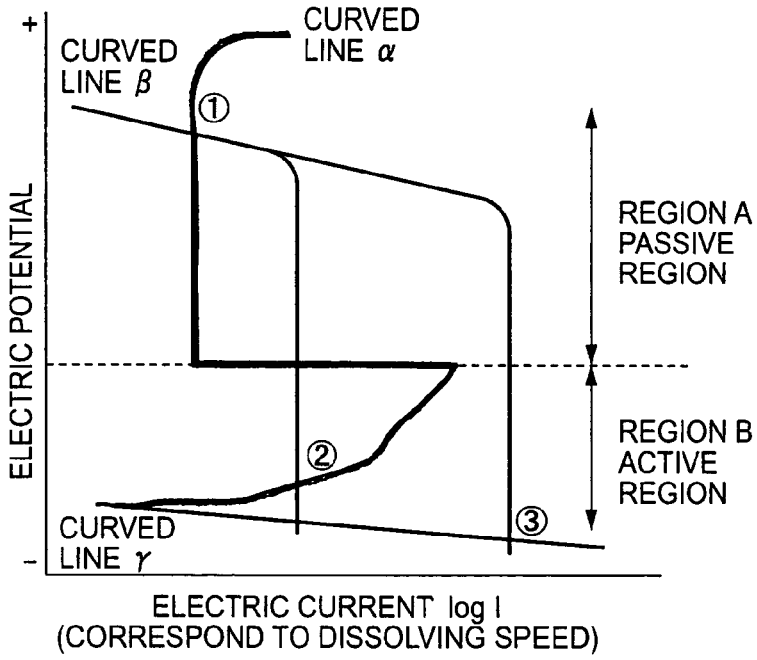
FIG. 1: General explaining chart showing active state-passive state of stainless steel.

Study of the electric potential of metal referring to the standard hydrogen electrode has been carried out widely in order to investigate a corrosive property of the metal in acid solution. The inventors measured electric potential on specimens by using collated Ag—AgCl electrode. FIG. 1 is a general explanation chart of a electric potential of a stainless steel showing an active region and passive region. The horizontal axis shows an electric current dencity being correspoding to a dissolving speed of corrosion. And the vertical axis shows an electric potential of metal where the more large value in the plus side shows the more strong oxidizing property of the acid solution. In this figure, curved line α represents a dissolving curve of the stainless steel, ①-incurved line β, ②-incurved line β and ③-in curved line β are representing reducing reactions of oxidizing components (nitric acid ion or Fe(III) ion) in the acid solution and curve γ is representing a reducing reaction of hydrogen ion. And the surface condition of stainless steel may be defined by the location of and the reaction degree at the crossing point of the dissolving curved line and reducing reaction curved lines.

Figure 2:
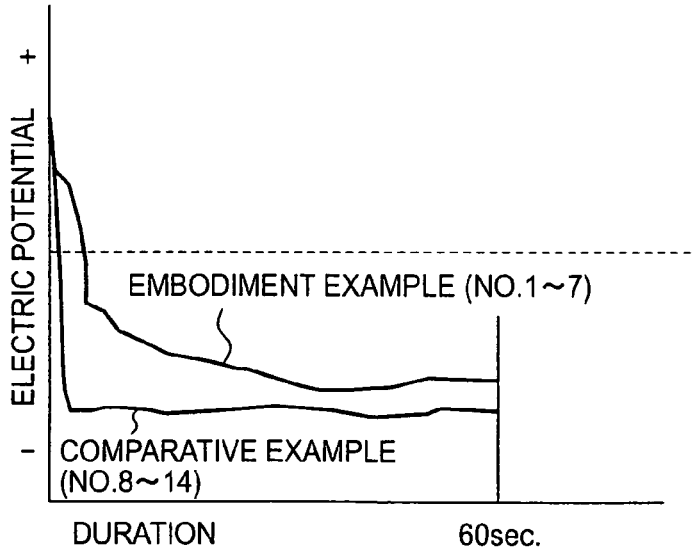
FIG. 2: Explaining chart of electric potential of stainless steel immersed in 1st treating solution of embodiment example and of comparative example.

The inventors immersed specimen into the 1st treating solution of No. 1–14 respectively, and provided an electric cell by accompanying of the specimen as one electrode and the collated Ag—AgCl electrode as the other electrode. And measured respectively the electric potential of the specimen by using an usual potentiometer. The temperature of the solution and the duration of immersion are shown in Table 1. FIG. 2 shows a result obtained by this measurements.

In FIG. 2, the electric potential of the specimen being immersed in the 1st treating solution of this invention comes to be in minus region, however, the curved line in the minus region is in a gentle slope and the specimen shows smooth and greyish coloured surface. On the other hand, in case of the 1st treating solution of comparative examples, the electric potential sharply drops in the minus region just after the immersion and shows excessive drop and vigorous corrosive reaction. In this case, thick smut are formed and shows rough and blackish coloured surface.

Figure 3:
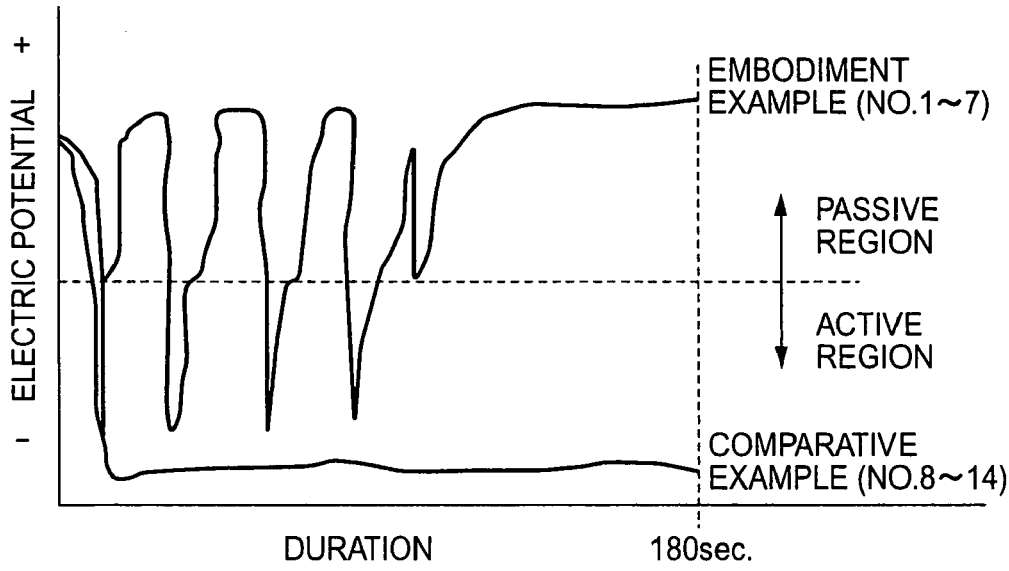
FIG. 3: Explaining chart of electric potential of stainless steel immersed in 2nd treating solution of embodiment example and of comparative example.

All specimens being treated in the 1st treating solution were water rinsed thoroughly, and then immersed respectively into the 2nd treating solutions being shown in Table 1. FIG. 3 shows the result of the measurements of the electric potential in the 2nd treating solutions. In the 2nd treating solution of the comparative example, the electrical potential sharply drops into the minus region in a short time and then becomes flat almost at the same level.

This shows an active state where the surface is not passivated and the corrosion of the specimen continues to proceed accompanying the hydrogen evolving reaction. And the blackish coloured surface are resulted at the end of the proceeding. On the other hand, in case of 2nd treating solution of this invention, the electric potential drops once into the minus region but moves into the plus region in a short time, and finally are kept flat in the plus region after repeating alternate change of this electric potential. Thus, in case of the 2nd treating solution of this invention, the active dissolution in the minus region and the passivation in the plus region are repeated, and the surface becomes smooth and milky white colour as the result of repeating of slight dissolution and passivation.

The inventors had carried out further the same study as shown in Table 1, FIG. 2 and FIG. 3 on other grades of stainless steel than JIS SUS420F, for example, on JIS SUS416, SUS420J2 and SUS440C where surface of those were greyish or blackish grey colour after the finishing process, and obtained the same results as explained.

Industrial Applicability of the Invention

This invention enbables to obtain a sufficiently smooth and bright milky white coloured surface being preferred by the consumers for such grades of stainless steel as JIS SUS416, SUS420F, SUS420 and SUS440C by replacing the conventional finishing process where insufficiently smooth and blackish coloured surface has been resulted.

TABLE 1

| | 1st treating solution 30° C., immerse for 60 sec. | | | | 2nd treating solution 30° C., immerse for 180 sec. | | |
|---|---|---|---|---|---|---|---|
| No. | $HNO_3$ g/l | HF g/l | $Fe^{3+}$ g/l | surface condition | $HNO_3$ g/l | $Fe^{3+}$ g/l | surface condition |
| 1 | 35 | 10 | 35 | Δ | 130 | 15 | ○ |
| 2 | 35 | 10 | 35 | Δ | 130 | 15 | ○ |
| 3 | 35 | 10 | 25 | Δ | 130 | 25 | ○ |
| 4 | 35 | 10 | 25 | Δ | 200 | 15 | ○ |
| 5 | 35 | 5 | 25 | Δ | 200 | 25 | ○ |
| 6 | 10 | 10 | 25 | Δ | 200 | 25 | ○ |
| 7 | 10 | 5 | 25 | Δ | 240 | 35 | ○ |
| 8 | 80 | 20 | — | X | 100 | <15 | X |
| 9 | 80 | 20 | — | X | 200 | <15 | X |
| 10 | 60 | 10 | — | X | 100 | <15 | X |
| 11 | 60 | 10 | — | X | 200 | <15 | X |
| 12 | 80 | 20 | — | X | 80 | <15 | X |
| 13 | 80 | 20 | — | X | 250 | <15 | X |
| 14 | 60 | 10 | — | X | 250 | <1.5 | X |

surface condition
○: milky white colour
Δ: greyish coloure or spotted colour of white and blackish
X: blackish colour

The invention claimed is:

1. A surface finishing process for martensitic stainless steel being carried out after removing the surface scale formed in hot working and/or heat treatment process, the process comprising the steps of:

(a) immersing the stainless steel into a 1st treating solution comprising nitric acid: 5–40 g/l, hydrofluoric acid: 2–10 g/l and Fe(III) ion: 15–40 g/l for 5–180 sec., then rinsing in water, (b) thereafter immersing the stainless steel into a 2nd treating solution comprising nitric acid: 120–250 g/l and Fe(III) ion: 15–40 g/l for 30–300 sec., then rinsing in water.

2. A surface finishing process for martensitic stainless steel being carried out after removing the surface scale formed in hot working and/or heat treatment process, the process comprising the steps of:

(a) immersing the stainless steel into a 1st treating solution consisting essentially of nitric acid: 5–40 g/l, hydrofluoric acid: 2–10 g/l and Fe(III) ion: 15–40 g/l for 5–180 sec., then rinsing in water, and (b) thereafter immersing the stainless steel into a 2nd treating solution consisting essentially of nitric acid: 120–250 g/l and Fe(III) ion: 15–40 g/l for 30–300 sec., then rinsing in water.

3. A surface finishing process for martensitic stainless steel being carried out after removing the surface scale formed in hot working and/or heat treatment process, the process comprising the steps of:

(a) immersing the stainless steel into a 1st treating solution consisting of nitric acid: 5–40 g/l, hydrofluoric acid: 2–10 g/l and Fe(III) ion: 15–40 g/l for 5–180 sec., then rinsing in water, and (b) thereafter immersing the stainless steel into a 2nd treating solution consisting of nitric acid: 120–250 g/l and Fe(III) ion: 15–40 g/l for 30–300 sec., then rinsing in water.

* * * * *